US010240887B1

(12) United States Patent
Henry

(10) Patent No.: US 10,240,887 B1
(45) Date of Patent: Mar. 26, 2019

(54) INLINE THUMB PUSH RELEASE FOR BOW STRING

(71) Applicant: Donald J. Henry, New Albany, PA (US)

(72) Inventor: Donald J. Henry, New Albany, PA (US)

( * ) Notice: Subject to any disclaimer, the term of this patent is extended or adjusted under 35 U.S.C. 154(b) by 0 days.

(21) Appl. No.: 15/673,986

(22) Filed: Aug. 10, 2017

Related U.S. Application Data

(60) Provisional application No. 62/373,553, filed on Aug. 11, 2016.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 2,819,707 A * 1/1958 Kayfes ..... F41B 5/1469 124/35.2
3,898,974 A * 8/1975 Keck ..... F41B 5/1469 124/35.2
4,004,564 A * 1/1977 Castonguay ..... F41B 5/1469 124/35.2
4,691,683 A * 9/1987 Peck ..... F41B 5/1469 124/35.2
4,930,485 A * 6/1990 Kopper ..... F41B 5/1415 124/23.1
5,103,796 A * 4/1992 Peck ..... F41B 5/1469 124/35.2

* cited by examiner

*Primary Examiner* — John Ricci
(74) *Attorney, Agent, or Firm* — John J. Elnitski, Jr.

(57) ABSTRACT

An inline thumb push release adapted to pull a bowstring of an archery bow by a user gripping the inline thumb push release and release the bow string to shoot an arrow by movement of a thumb of user. The inline thumb push release having a grip adapted to fit a hand of a user; a bowstring catch attached to the grip, the bowstring catch including a catch tip adapted to hold on to the bowstring during pulling by the user; and a thumb rest attached to the grip and connected to the bowstring catch such that the user gripping the grip and pulling back on the grip to pull back the bowstring being held by the catch tip can release the bowstring from the catch tip by pushing the thumb rest with the thumb while continuing to grip the grip in a pulling motion.

11 Claims, 8 Drawing Sheets

INLINE THUMB PUSH RELEASE FOR BOW STRING

This application claims the benefit of and incorporates by reference U.S. Provisional Application No. 62/373,553, filed Aug. 11, 2016.

BACKGROUND

The present invention generally relates to archery bows. More specifically, the present invention relates to bow string releases for an archery bow.

With a standard thumb release on the market, both the hand and thumb are pulling the release away from the bow to sets the trigger off. The thumb post is offset from the main release. This is done so that the release fits into the hand and it is easy to center the thumb in front of the post. With the release and thumb being offset this means there will be some hand torque or hand movement as the release is going off. What is needed in a release is a device which is easier to use and more natural to the user.

It is an object of the present invention to provide an inline thumb push release that is easier to use.

SUMMARY OF THE INVENTION

An inline thumb push release adapted to pull a bowstring of an archery bow by a user gripping the inline thumb push release and release the bow string to shoot an arrow by movement of a thumb of user. The inline thumb push release having a grip adapted to fit a hand of a user; a bowstring catch attached to the grip, the bowstring catch including a catch tip adapted to hold on to the bowstring during pulling by the user; and a thumb rest attached to the grip and connected to the bowstring catch such that the user gripping the grip and pulling back on the grip to pull back the bowstring being held by the catch tip can release the bowstring from the catch tip by pushing the thumb rest with the thumb while continuing to grip the grip in a pulling motion.

DETAILED DESCRIPTION

The present invention is an inline thumb push release, as shown in FIGS. 1-8. The inline thumb push release is activated by a user's thumb pushing on a thumb rest 10 towards the bow, while the hand of the user is pulling the inline thumb push release that is holding the bowstring away from the bow. The front of the user's thumb is placed against the thumb rest 10, while the hand of the user pulls on the grip 12, the thumb pushes the thumb rest 10 towards the archery bow. By the thumb going forward, it causes a release assembly in the inline thumb push release to trigger release of the bowstring with very light pressure. This push-pull concept has never been attempted before in a release and improves accuracy of the shot. This is because there is no tendency for the hand of the user to move during manipulation of the release assembly, which means no deflection of the hand, and thus allowing a smooth straight shot coming from the archery bow.

Figure 1:
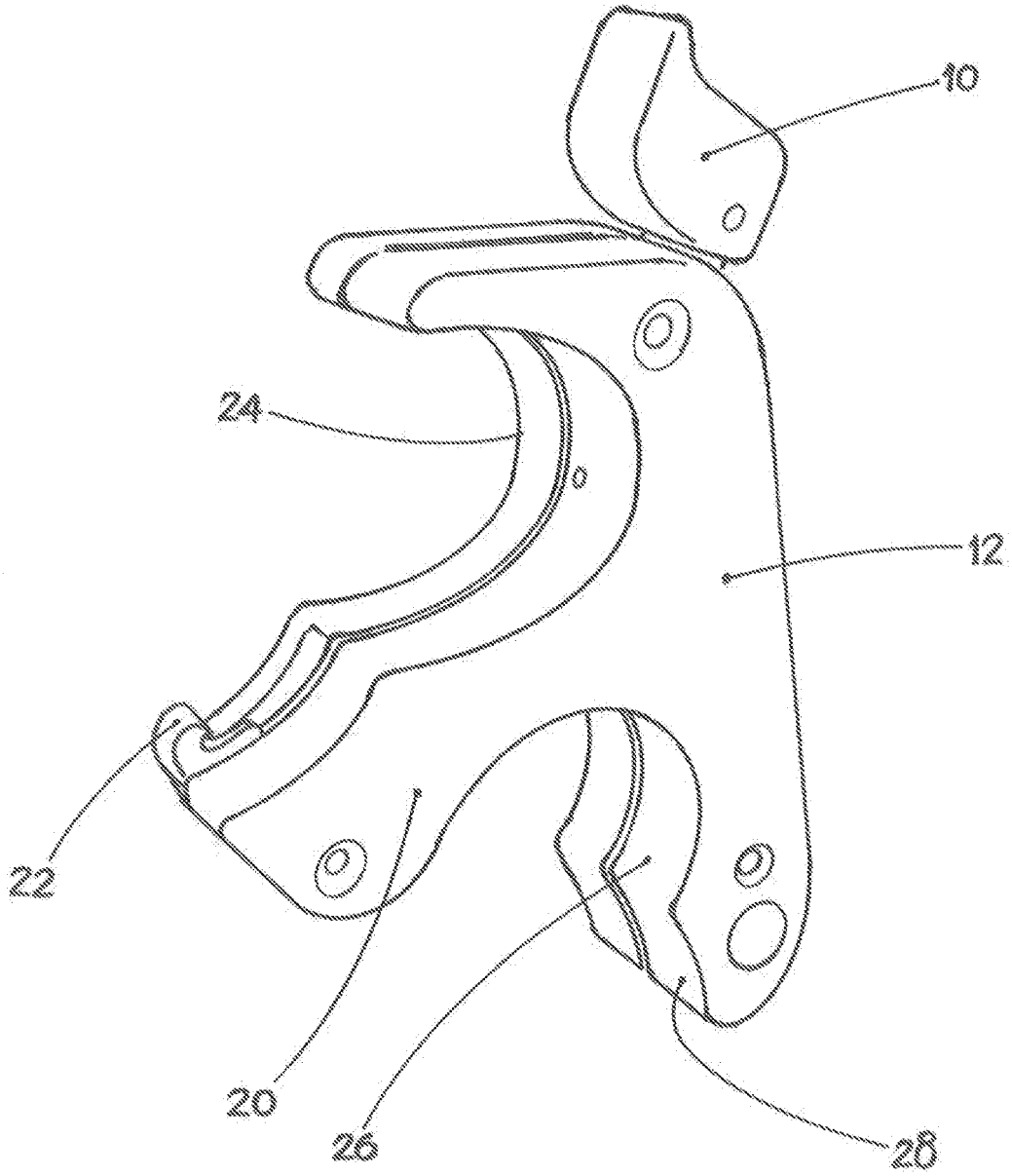
FIG. 1 is a perspective front view of an inline thumb push release according to the present invention.
Figure 2:
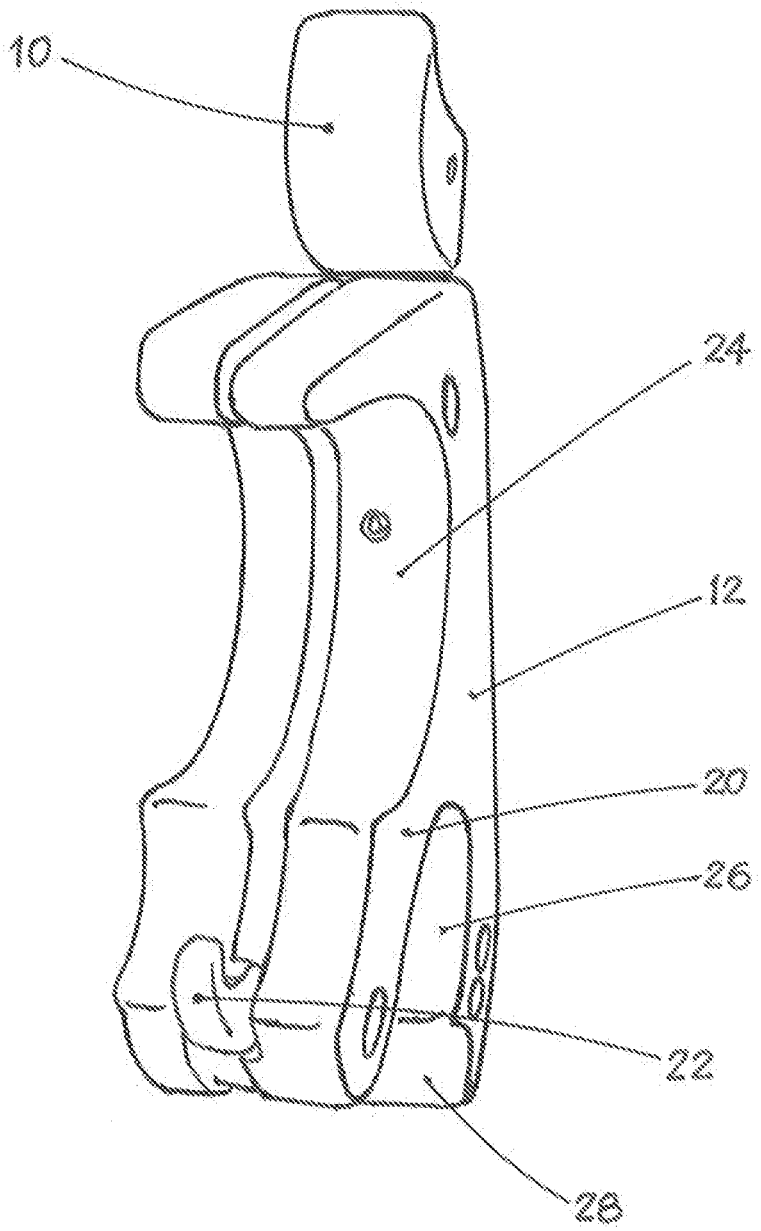
FIG. 2 is a perspective front view of an inline thumb push release according to the present invention.
Figure 3:
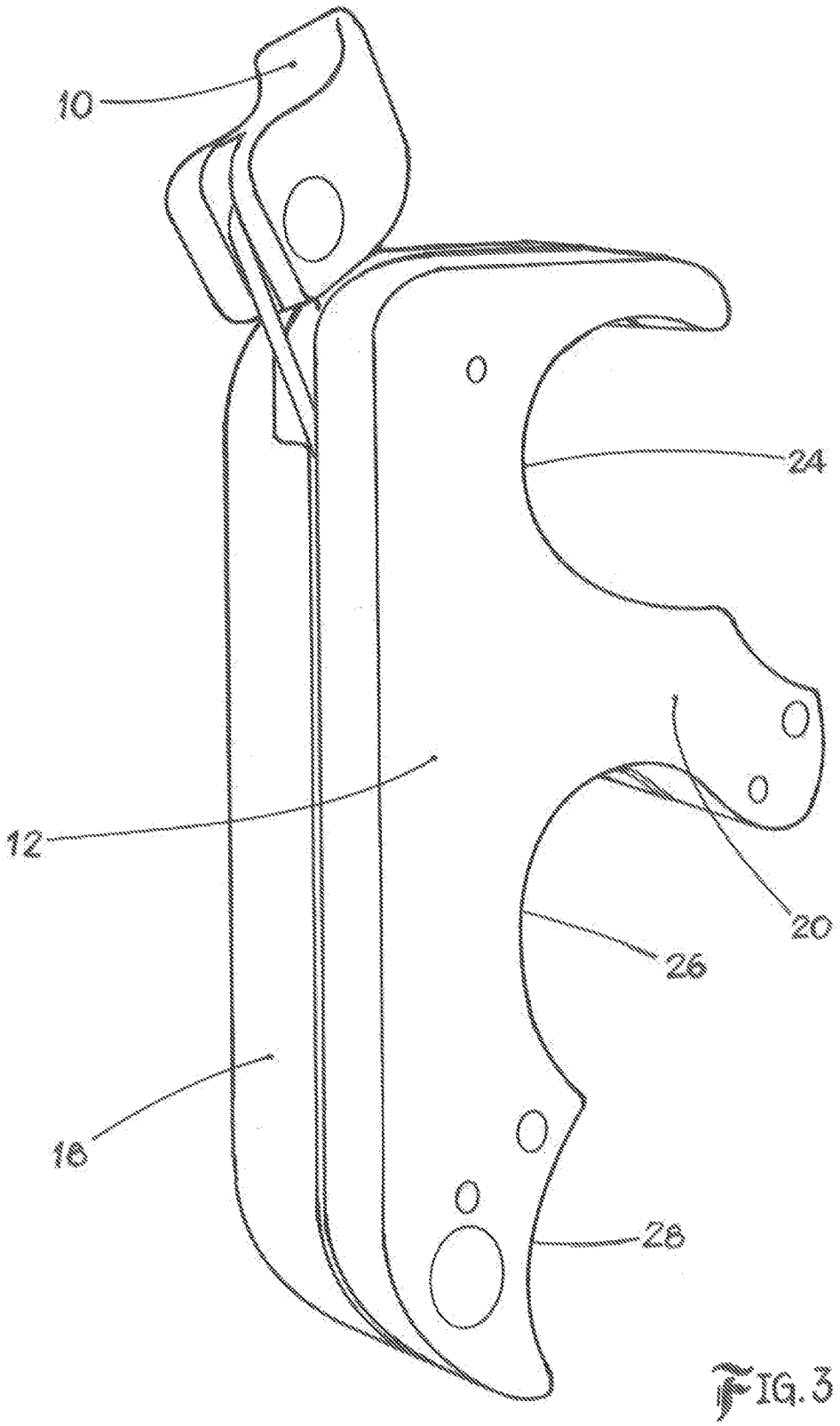
FIG. 3 is a perspective rear view of an inline thumb push release according to the present invention.
Figure 4:
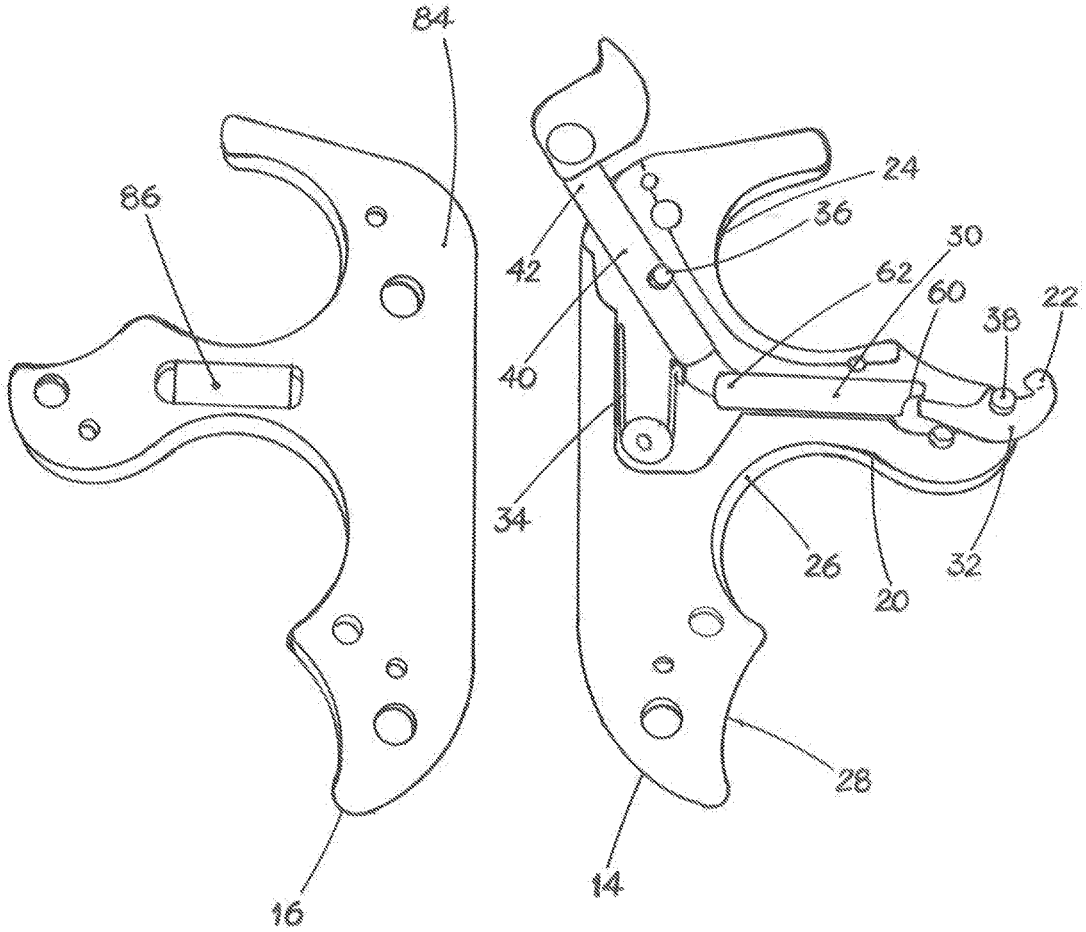
FIG. 4 is a exploded view of an inline thumb push release according to the present invention.

The inline thumb push release includes the grip 12 and the release assembly. The grip 12 includes two halves as shown in FIG. 4. The first half is a main body 14. The second half is a cover plate 16 to access the main body 14. The main body 14 is a grip shape with three finger depressions to receive three fingers and a back 18 to support most of the user's hand. The main body 14 also includes bowstring extension 20 extending out from the main body 14. The bowstring extension 20 includes a catch tip 22 at the end. The first finger depression 24 is above the catch extension 20 to receive the index finger. The second finger depression 26 is below the catch extension 20 to receive the middle finger. The third finger depression 28 is below the second finger depression 26 to receive the ring finger.

Figure 5:
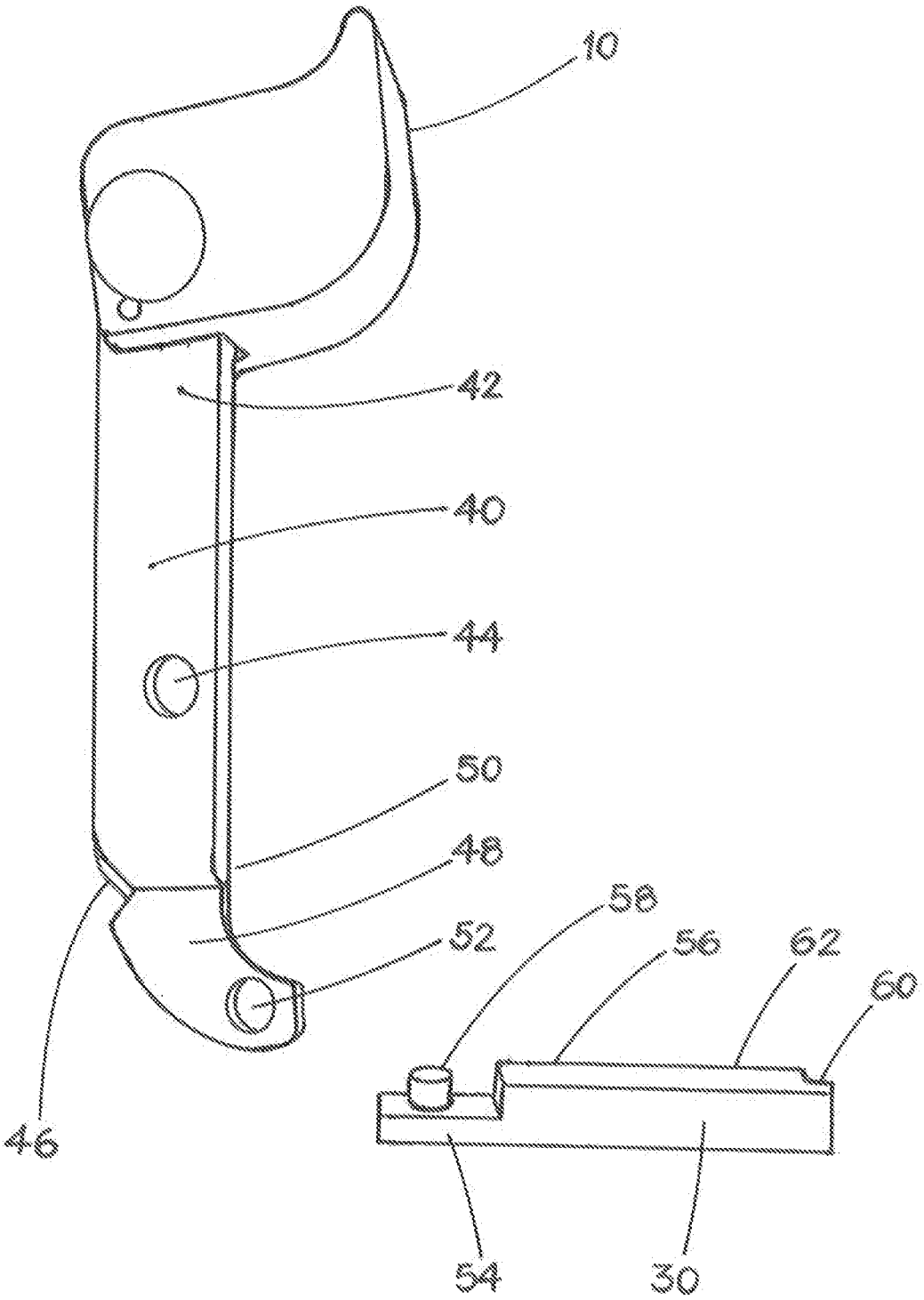
FIG. 5 is a perspective view of part of a release assembly according to the present invention.
Figure 6:
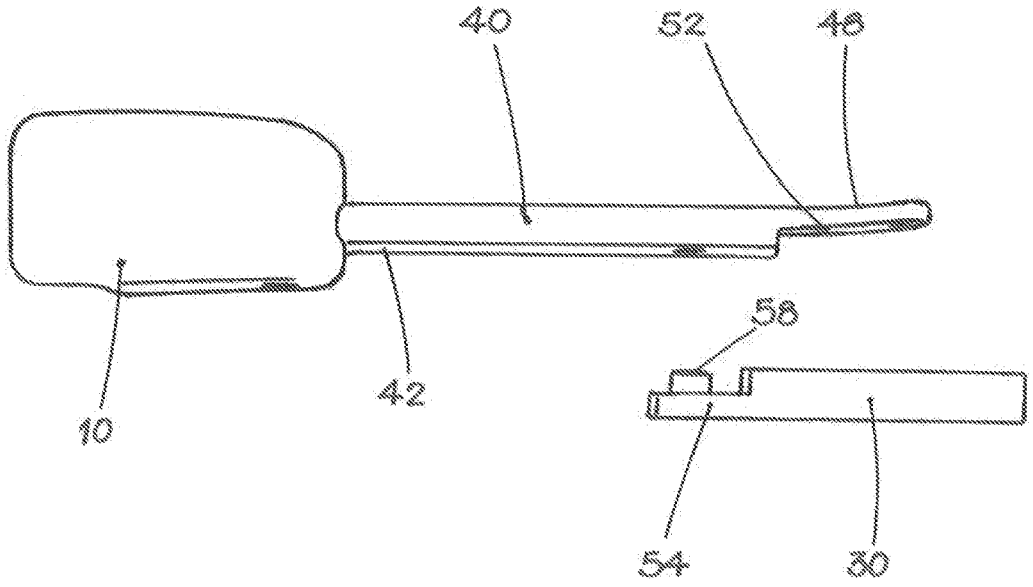
FIG. 6 is a perspective view of part of a release assembly according to the present invention.
Figure 7:
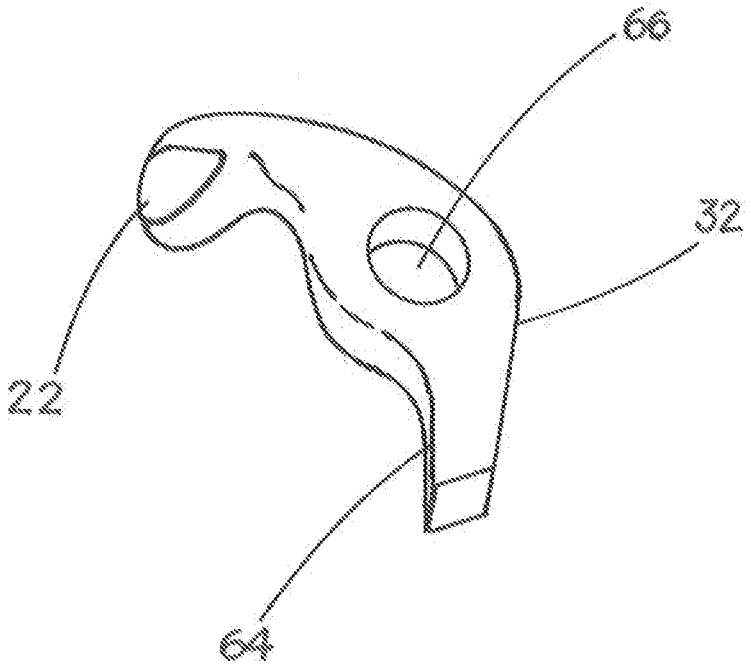
FIG. 7 is a perspective view of part of a catch according to the present invention.

FIG. 4 shows the release assembly mounted in the main body 14. The release assembly includes, the thumb trigger, pull bar 30, catch 32, spring 34, trigger axle 36 and catch axle 38. The thumb trigger includes a trigger bar 40 and the thumb rest 10, as shown in FIGS. 5-6. The thumb rest 10 is attached to a first end 42 of the trigger bar 40. The trigger bar 40 includes axle hole 44 and spring detent 46. The trigger bar 40 includes a trigger bar flange 48 at a second end 50. The trigger bar flange 48 includes a pull bar hole 52. The pull bar 30 includes a pull bar flange 54 at a first end 56, as shown in FIGS. 5-6. A pull bar axle 58 extends out from the pull bar flange 54. The pull bar 30 includes catch detent 60 at a second end 62. The catch 32 includes a catch arm 64 and the catch tip 22, as shown in FIG. 7. There is a catch axle hole 66 between the catch arm 64 and catch tip 22. The catch tip 22 is curved hook to hook and hold the bowstring. The trigger axle 36 is mounted in a release assembly recess 68 and catch axle 38 is mounted in a catch recess 70.

Figure 8:
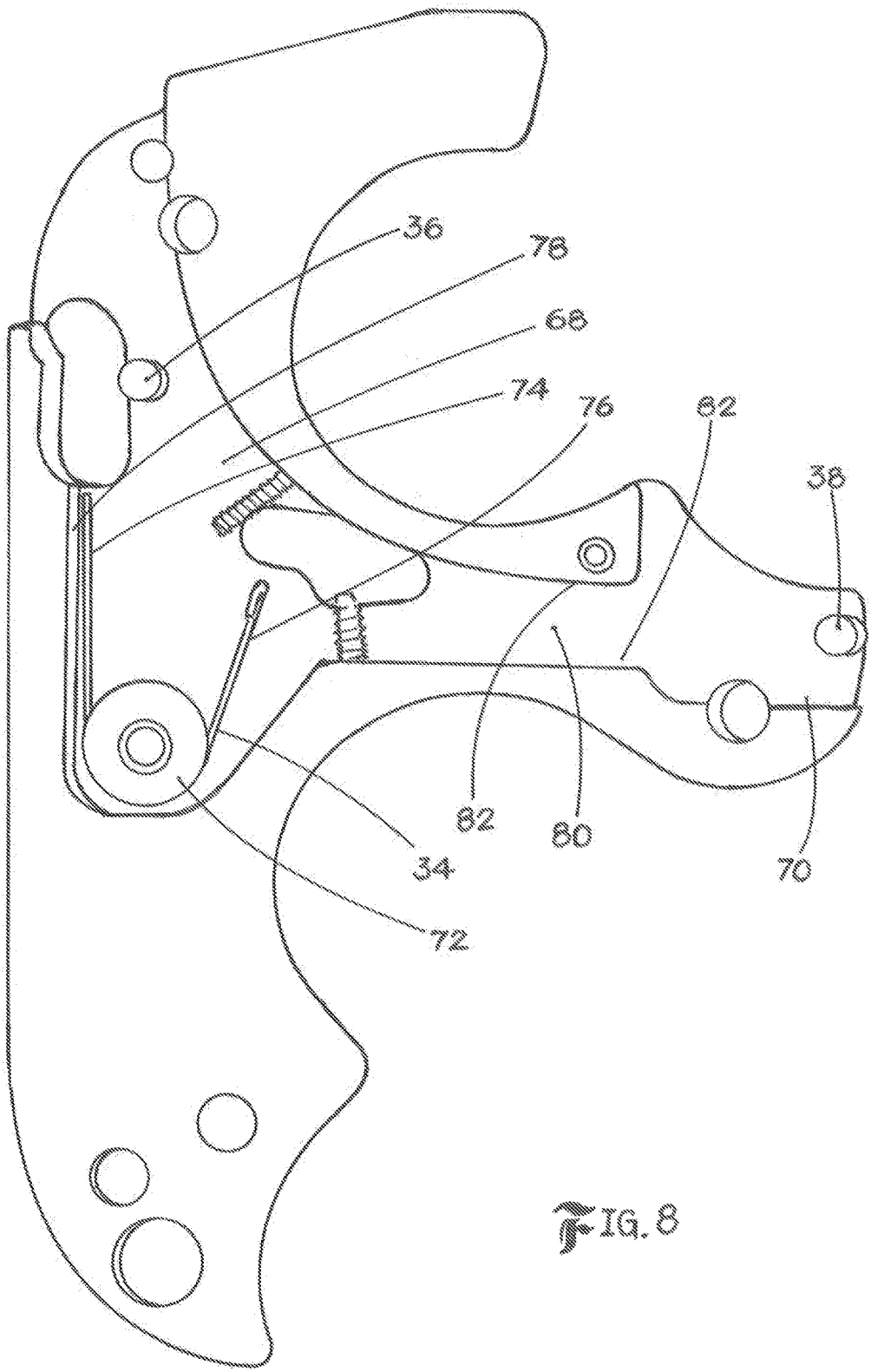
FIG. 8 is a side view of main body according to the present invention.

The trigger bar 40 is mounted into a release assembly recess 68 in the main body 14. FIG. 8 shows the release assembly recess 68 without the release assembly. The trigger bar 40 is mounted onto the trigger axle 36 using the axle hole 44, such that the trigger bar 44 can rotate about the trigger axle 36. The spring 34 is mounted in the release assembly recess 68 using a screw 72, as shown in FIGS. 4 and 8. The spring 34 is shown with a support leg 74 and trigger pressure leg 76. The support leg 74 provides spring tension and engages a wall 78 of the release assembly recess 68. The trigger pressure leg 76 engages the spring detent 46 in the trigger bar 40 and provides pressure to bias the second end 50 of the trigger bar 40 towards the catch 32. The main body includes a pull bar recess 80. The pull bar recess 80 receives the pull bar 30. The pull bar recess 80 includes slide walls 82 to contain the pull bar 30 so the pull bar 30 can only move by sliding in the pull bar recess 80 and along the slide walls 82. The pull bar 30 is connected to the trigger bar 40 during installation of the pull bar 30. The pull bar axle 58 of the pull bar flange 54 fits into the pull bar hole 52 of the trigger bar flange 48, such that the pull bar flange 54 and trigger bar flange 48 mate to form a thickness no thicker than either the pull bar 30 or the trigger bar 40. The pull bar axle 58 and the pull bar hole 52 allow the trigger bar 40 to rotate about the pull bar 30 to provide freedom of movement. The catch 32 is mounted on the catch axle 38, so that the catch arm 64 of the catch 32 fits into the catch detent 60 of the pull arm 30 when the release assembly is in a ready position. Where the ready position is where the thumb rest 10 is not being pushed. The cover 16 is mounted to the main body 14 to cover the release assembly. The cover 16 includes an inside surface 84 that faces the main body 14 when mounted to the main body 14. The inside surface 84 includes a plastic surface 86 that is recessed into the cover 14 and aligns to contact the pull bar 30, as shown in FIG. 4. The plastic surface 86 is usually a Delrin material that acts as a bearing surface against the pull bar 30 to enhance movement of the pull bar 30 as it slides in the pull bar recess 80.

When the catch tip 22 is attached to the bow string, the user pulls the bow string by pulling back on the grip 12. When the user pushes the thumb rest 10 forward, the trigger bar 40 rotates on the trigger bar axle 36 against the force of the spring 34. Rotation of the trigger bar 40 pulls the pull bar 30 away from the catch arm 64 and releases the catch 32. Release of the catch arm 64 allows the catch 32 to rotate on the catch axle 38 and the bowstring is released from the catch tip 22 due to the bowstring pulling the catch tip 22 with the bowstring. The release assembly is reset by releasing the thumb rest 10 and rotating the catch 32 until the catch arm 65 engages the catch detent 60 of the pull bar 30.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. An inline thumb push release, adapted to pull a bowstring of an archery bow by a user gripping said inline thumb push release and release the bow string to shoot an arrow by movement of a thumb of user, comprising:

a grip adapted to fit a hand of a user;

a bowstring catch attached to said grip, said bowstring catch including a catch tip adapted to hold on to the bowstring during pulling by the user;

a thumb rest attached to said grip and connected to said bowstring catch such that the user gripping said grip and pulling back on said grip to pull back the bowstring being held by said catch tip can release the bowstring from said catch tip by pushing said thumb rest with the thumb while continuing to grip said grip in a pulling motion; and a spring interconnected to said thumb rest to bias said thumb rest in a ready position when said catch tip is holding the bowstring and wherein said spring biases said connection between said thumbrest and said bowstring catch to apply pressure to hold said catch tip in place.

2. The inline thumb push release of claim 1, wherein said grip includes a first finger depression adapted to receive an index finger, a second finger depression adapted to receive a middle finger and a third finger depression adapted to receive a ring finger.

3. The inline thumb push release of claim 1, wherein said grip includes a release assembly, said release assembly comprising: a trigger bar connected to said thumb rest, a pull bar connected to said trigger bar and able to engage and hold in place said bowstring catch; and wherein pushing on said thumb rest while gripping said grip during the pulling motion causes said trigger bar to pull on said pull bar to disengage from said bowstring catch to allow release of said catch tip from the bowstring.

4. The inline thumb push release of claim 3, wherein said trigger bar is rotatably attached inside said grip such that pushing on said thumb rest that is connected to first end of said trigger bar causes a second end of said trigger bar to move away from said pull bar; wherein said catch includes a catch arm extending from said catch tip; wherein said pull bar includes a first end attached to said second end of said trigger bar such that said trigger bar moving away from said pull bar pulls said pull bar in that direction; and wherein said pull bar includes a detent that engages said catch arm and releases said catch arm when said pull bar is pulled by said trigger bar.

5. The inline thumb push release of claim 4, wherein said catch rotatably attached to said grip so that said catch can rotate away from the bowstring.

6. The inline thumb push release of claim 4, wherein said pull bar includes a pull bar flange at said first end and includes a pull bar axle extending out from said pull bar flange; and wherein said trigger bar includes a trigger bar flange at said second end and said trigger bar flange includes a pull bar hole to receive said pull bar axle.

7. The inline thumb push release of claim 6, wherein said catch rotatably attached to said grip so that said catch can rotate away from the bowstring.

8. The inline thumb push release of claim 6, further including a spring connected to said trigger bar to bias said trigger bar and bias said thumb rest in a ready position where said catch tip is holding the bowstring and wherein said spring biases said trigger bar to apply pressure to said pull bar and hold said catch arm in place.

9. The inline thumb push release of claim 8, wherein said catch rotatably attached to said grip so that said catch can rotate away from the bowstring.

10. The inline thumb push release of claim 4, further including a spring connected to said trigger bar to bias said trigger bar and bias said thumb rest in a ready position where said catch tip is holding the bowstring and wherein said spring biases said trigger bar to apply pressure to said pull bar and hold said catch arm in place.

11. The inline thumb push release of claim 10, wherein said catch rotatably attached to said grip so that said catch can rotate away from the bowstring.

* * * * *